US010815046B2

(12) United States Patent
Wells

(10) Patent No.: US 10,815,046 B2
(45) Date of Patent: Oct. 27, 2020

(54) SIZE-SELECTIVE AEROSOL NOZZLE DEVICE

(71) Applicant: Byoplanet International, LLC, Sunrise, FL (US)

(72) Inventor: James Brandon Wells, Winterville, GA (US)

(73) Assignee: Byoplanet International, LLC, Sunrise, FL (US)

( * ) Notice: Subject to any disclaimer, the term of this patent is extended or adjusted under 35 U.S.C. 154(b) by 216 days.

(21) Appl. No.: 15/911,105

(22) Filed: Mar. 3, 2018

(65) Prior Publication Data

US 2019/0270100 A1 Sep. 5, 2019

(51) Int. Cl.

| | |
|---|---|
| ***B65D 83/28*** | (2006.01) |
| ***B05B 7/00*** | (2006.01) |
| ***B05B 12/14*** | (2006.01) |

(52) U.S. Cl.

CPC ..... *B65D 83/28* (2013.01); *B05B 7/0012* (2013.01); *B05B 12/1409* (2013.01)

(58) Field of Classification Search

CPC ..... B05B 5/03; B05B 5/032; B05B 12/1409; B05B 7/1459; B05B 15/52; B05B 15/58; B05B 1/26; B05B 1/262; B05B 1/265; B05B 1/267; B05B 1/14; B05B 1/28; B05B 1/3093; B05B 14/30; B05B 12/36; B05B 7/0012; C23C 14/0063; C23C 14/5873; C23C 14/588; C23C 14/5886; B65D 83/28–687

USPC ..... 118/17, 18, 20, 326; 239/120, 499, 500, 239/504, 518, 520, 523, 524, 548, 239/124–127, 119, 104, 704, 337, 338; 222/564, 547, 402.1–402.25, 330, 331

See application file for complete search history.

(56) References Cited

U.S. PATENT DOCUMENTS

| | | | | |
|---|---|---|---|---|
| 3,680,740 | A * | 8/1972 | Kinnavy | B65D 83/60 222/129 |
| 4,168,460 | A | 9/1979 | Menke | |
| 4,255,777 | A | 3/1981 | Kelly | |
| 4,380,786 | A | 4/1983 | Kelly | |
| 4,562,966 | A | 1/1986 | Smith et al. | |
| 4,619,401 | A | 10/1986 | Hardman | |

(Continued)

*Primary Examiner* — Alex M Valvis
*Assistant Examiner* — Juan C Barrera
(74) *Attorney, Agent, or Firm* — Mark C. Johnson; Johnson Dalal

(57) ABSTRACT

A size-selective aerosol nozzle that includes an impactor body with an internal enclosed sidewall spanning in a directional longitudinally from a distal end of a distal spray end to a central sidewall terminal end and defining a central spray channel and a fluid segregation member. The segregation member may include an internal enclosed sidewall defining at least one liquid removal channel spanning laterally away from a central spray channel, defining a second aerosol discharge outlet in fluid communication with the central spray channel, and spans into the central spray channel to bifurcate the central spray channel into the liquid removal channel and an aerosol discharge channel. The fluid segregation member has an inner surface defining the liquid removal channel and is in an overlapping configuration with the internal enclosed sidewall to mechanically segregate emitted aerosol spray from the first aerosol discharge outlet of a portable hand-held aerosol spray assembly.

11 Claims, 9 Drawing Sheets

(56) References Cited

U.S. PATENT DOCUMENTS

| | | | | |
|---|---|---|---|---|
| 4,659,013 | A | 4/1987 | Ledebuhr et al. | |
| 4,819,878 | A | 4/1989 | Bailey et al. | |
| 5,268,018 | A | 12/1993 | Mourer et al. | |
| 5,609,919 | A | 3/1997 | Yuan et al. | |
| 5,785,250 | A * | 7/1998 | De Laforcade | B05B 1/26 222/402.1 |
| 5,800,598 | A * | 9/1998 | Chein | A61M 11/001 55/318 |
| 6,027,043 | A * | 2/2000 | Rosenberg | B05B 1/265 239/382 |
| 6,325,305 | B1 * | 12/2001 | Kuhlman | E21B 37/00 166/222 |
| 6,544,312 | B2 | 4/2003 | Mullinger et al. | |
| 9,138,760 | B2 | 9/2015 | Cooper | |
| 9,144,811 | B2 | 9/2015 | Cooper | |
| 9,352,340 | B2 * | 5/2016 | Bourrilhon | B05B 7/0012 |
| 2002/0071871 | A1 | 6/2002 | Snyder et al. | |
| 2003/0047824 | A1 | 3/2003 | Hanna et al. | |
| 2004/0140374 | A1 | 7/2004 | Synder et al. | |
| 2010/0044474 | A1 | 2/2010 | Allen et al. | |

* cited by examiner

700

800

1000

| LSVI | Major Flow ON | Major Flow OFF | Decrease Percent |
|---|---|---|---|
| Particle concentration (#/Liter) (<0.523 µm) | 51,436 | 478,118 | 90.7 |
| Particle concentration (#/Liter) (0.523 - 1.0 µm) | 7,205 | 62,585 | 91.3 |

FIG. 10

SIZE-SELECTIVE AEROSOL NOZZLE DEVICE

FIELD OF THE INVENTION

The present invention relates generally to an aerosol nozzle device, and, more particularly, relates to an aerosol nozzle for selectively removing small aerosol particles from an aerosol distribution.

BACKGROUND OF THE INVENTION

Generally, spray coating devices apply a spray coating to a wide variety of structures and materials, such as wood and metal. The spray coating fluids used for each different industrial application may have much different fluid characteristics and desired coating properties. For example, wood coating fluids are generally viscous fluids, which may have significant particulate and ligaments throughout the fluid. Existing spray coating devices, such as air atomizing spray guns, are often unable to break up the foregoing particulate/ligaments. The resulting spray coating has an undesirably inconsistent appearance, which may be characterized by mottling and various other inconsistencies in textures, colors, and overall appearance.

It is known in the art that in operation of an induction charged electrostatic nozzle, air and liquid enter the rear of the nozzle separately. The air moves through the nozzle under pressure and meets the liquid at the nozzle tip, causing the formation of spray droplets that may be approximately 30 to 60 microns in diameter, but may less or outside of said range. At the tip of the nozzle is a tiny electrode which applies an electrical charge to the spray. The electrical charging causes a natural force of attraction between the spray droplets and a target surface. The attraction to the surface of a target relates to Coulomb's Law, which states that any two charged objects will create a force on each other.

Some devices and/or structures have been created to segregate liquid particles in a fluid flow for various purposes and applications. Some of these devices are what are referred to as "impactors." "Virtual impactors" are used to separate liquid particles into various sizes using airstreams utilizing spaces of stagnant or slow-moving air, as opposed to impaction surfaces. Regardless, these impactors are generally unable or commercially impractical for use with portable aerosol units. However, some spray impactors are internally designed and configured to create small aerosol particles in the respiratory range (e.g., submicron particle size range, <0.523 μm-1 μm), e.g., for medicinal purposes. The size distribution, however, can be problematic if the solution or liquid emitted is harmful to the user and other individuals in the surrounding ambient area of emission.

Therefore, a need exists to overcome the problems with the prior art as discussed above.

SUMMARY OF THE INVENTION

The invention provides an aerosol nozzle device that overcomes the hereinafore-mentioned disadvantages of the heretofore-known devices and methods of this general type and that segregates small, inhalable droplets from a solid liquid column of a particulate substance after atomization through use of an induction charged electrostatic nozzle and an attached droplet impactor that couple together in an overlapping, sheared geometric configuration, and further may include vacuum-assisted liquid removal channels, charged electrodes, and dimensionally adjustable boreholes, cavities, passageways, and conduit slopes to enable segregation of the smaller, inhalable droplets of the particulate substance from the solid liquid column after atomization.

With the foregoing and other objects in view, there is provided, in accordance with the invention, an aerosol nozzle device that comprises of a nozzle. The nozzle is configured to receive a solid liquid column of a particulate substance and discharging a particulate spray cloud. The nozzle comprises a central spray channel carrying the solid liquid column of particulate substance, the central spray channel defined by a source end and a discharge end that forms an orifice.

The nozzle further comprises a reverse conical member defined by a borehole. The borehole is defined by a diameter. The borehole is concentric and in communication with the central spray channel. The reverse conical member is further defined by a wide end and a narrow end joined with the discharge end of the central spray channel. The diameter of the borehole is adjustable to regulate passage of the particulate spray cloud through the reverse conical member.

The nozzle further comprises an air inlet that carries pressurized air through the particulate substance that is discharging from the wide end of the reverse conical member. The pressurized air integrates into the solid liquid column to create a particulate spray cloud.

The nozzle further comprises at least one electrode disposed proximal to the reverse conical member. The at least one electrode generates an electric field through the particulate spray cloud, so as to polarize the particulates and create deviation from the particulate spray cloud. The charge of the at least one electrode is adjustable to regulate deviation of the smaller particulates of the particulate spray cloud towards the outlet passageway.

In some embodiments, the device includes an impactor that carries and disperses the particulate spray cloud. The impactor also works to segregate the smaller particulate droplets from the spray cloud. The impactor is defined by a mount end coupled to the wide end of the reverse conical member. The mount end has sidewalls that form a cavity for receiving the electrified spray cloud from the reverse conical member. The cavity defined by a dimension that can be increased or decreased to regulate passage of the particulate spray cloud through the first aerosol discharge outlet and the outlet passageway of the liquid removal channel.

The impactor is further defined by a cap end forming a first aerosol discharge outlet through which a portion of the primary spray cloud discharges for use. The first aerosol discharge outlet is in communication with the cavity, receiving and enabling free passage of the spray cloud therefrom. The first aerosol discharge outlet is defined by a first width that can be size adjusted. The first width of the first aerosol discharge outlet is adjustable to regulate passage of the particulate spray cloud.

In some embodiments, the device includes at least one liquid removal channel that carries a portion of the particulate, including the small droplets, away from the spray cloud. The liquid removal channel is defined by an inlet passageway in communication with the cavity. The inlet passageway is defined by a second width that is adjustable to regulate the amount and/or size of small droplets passing through. The inlet passageway disposed generally perpendicular to the first aerosol discharge outlet formed in the impactor.

The at least one liquid removal channel is further defined by an outlet passageway in communication with a vacuum. The quality of the vacuum is adjustable to regulate the number of small droplets being removed from the spray cloud into the liquid removal channel. The outlet passageway is disposed at a slope and/or is canted relative to the first aerosol discharge outlet formed in the impactor. The slope is adjustable to regulate the number of small droplets being removed from the spray cloud into the liquid removal channel.

In another aspect, the nozzle is an induction charged electrostatic nozzle.

In another aspect, the central spray channel is an elongated tube.

In another aspect, the portion of the particulate droplets from the particulate spray cloud passing through the first aerosol discharge outlet are generally larger than 15 micrometers.

In another aspect, the smaller particulates of the particulate spray cloud passing through the outlet passageway are generally between 10 to 15 micrometers.

In another aspect, the quality of the vacuum comprises a pressure of about 1-20 millimeters of mercury.

In another aspect, the first width of the first aerosol discharge outlet is about 0.246 inches.

In another aspect, the second width of the inlet passageway is about 0.118 inches.

In another aspect, the dimension of the cavity that forms in the impactor is about 0.175 inches in height.

In another aspect, the slope of the outlet passageway relative to the first aerosol discharge outlet of the impactor is about fifteen degrees.

In another aspect, the slope of the outlet passageway is oriented away from the first aerosol discharge outlet.

In another aspect, the device further comprises a nozzle cover detachably encapsulating the nozzle.

In another aspect, the particulate substance includes at least one of the following: paint, ink, and a chemical.

In another aspect, the at least one liquid removal channel is integral with the impactor.

In another aspect, the at least one liquid removal channel comprises two oppositely disposed tubes.

In another aspect, the device emulates the function of a size-selective virtual impactor.

In another aspect, the device is removably coupled to the nozzle.

In another aspect, the device is integrally coupled to the nozzle.

One objective of the present invention is to segregate smaller, inhalable droplets of a particulate substance (10-15 μm) for recycling or discarding from larger droplets in an atomized spray cloud.

Another objective is to reduce the production of small (<10 μm) droplets produced by the currently known nozzle assemblies employed with aerosol systems.

Another objective is to toxicology risk level of a spray cloud of a particulate substance below EPA limits.

Another objective is to create a more uniform spray cloud.

Another objective is to provide adjustable pressure to a vacuum to regulate the size of droplets that are segregated in an atomized spray cloud.

Another objective is to provide adjustable charges to electrodes to regulate the size of droplets that are segregated in an atomized spray cloud.

Another objective is to adjust the geometric dimensions of boreholes, cavities, passageways, and conduit slopes to enable segregation of the smaller, inhalable droplets of the particulate substance from the solid liquid column after atomization.

Another objective is to adjust the slope of the liquid removal channels to regulate the size of droplets that are segregated in an atomized spray cloud.

Another objective is to recycle small droplets back into the solid liquid column for reuse.

Another objective is to provide an inexpensive to manufacture atomizing device.

Although the invention is illustrated and described herein as embodied in an aerosol nozzle device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" should be understood to mean in a direction corresponding to an elongated direction of the aerosol nozzle device.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 10 is a testing table, depicting particle concentrations associated with the virtual impacting aerosol nozzle device, in accordance with an embodiment of the present invention.

DETAILED DESCRIPTION

Figure 1:
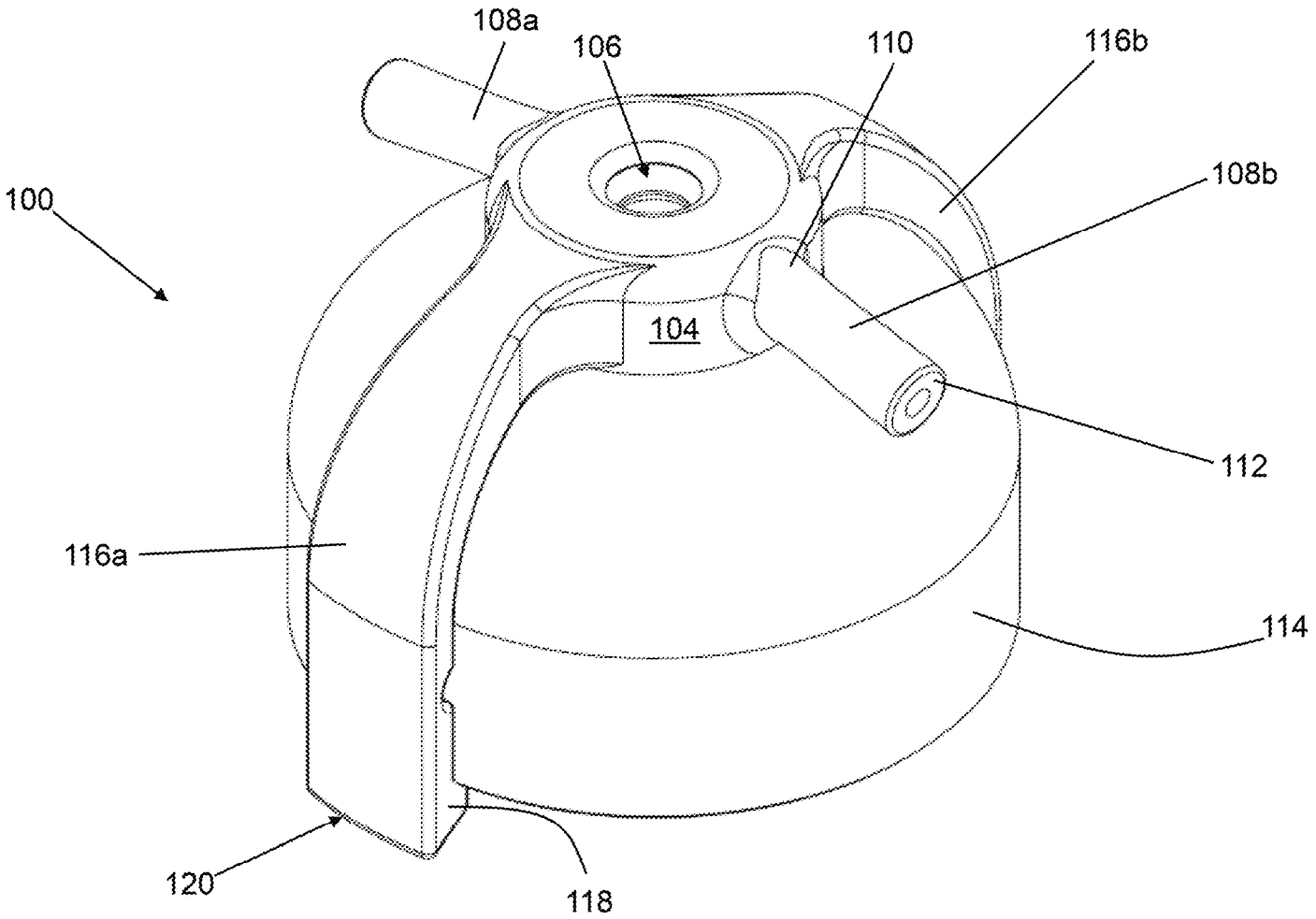
FIG. 1 is a perspective view of an exemplary size-selective aerosol nozzle attachment device, in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient impacting aerosol nozzle device 100. Embodiments of the invention work to reduce the production of small droplets less than approximately 10 μm that are produced by the currently known nozzle assemblies employed with aerosol systems. In addition, embodiments of the invention provide a mechanical and vacuum-assisted size-selective aerosolized droplet impactor 102 that is attached as a couplable accessory to, or integral with, for example, an air-assisted induction charged electrostatic nozzle 300 (best seen depicted in FIG. 3). The impactor carries and disperses the particulate substance as a spray cloud.

The intention behind the device 100 is to scavenge out low mass droplets with specific focus to those produced in the inhalable size range. Adjustments to either internal geometry, electrical field charge, and vacuum levels provides a tunable performance for selective sizing of the droplets. Similar in operation to a virtual impact, this is a proven mechanism utilized in hydraulic nozzle assemblies to segregate specific cut sizes within a liquid spray after the atomizing stage. These segregated droplets may then be reinserted into the original supply flow, or drained off and discarded. Further, inhalation of the smaller particulate droplets is minimized.

Figure 3:
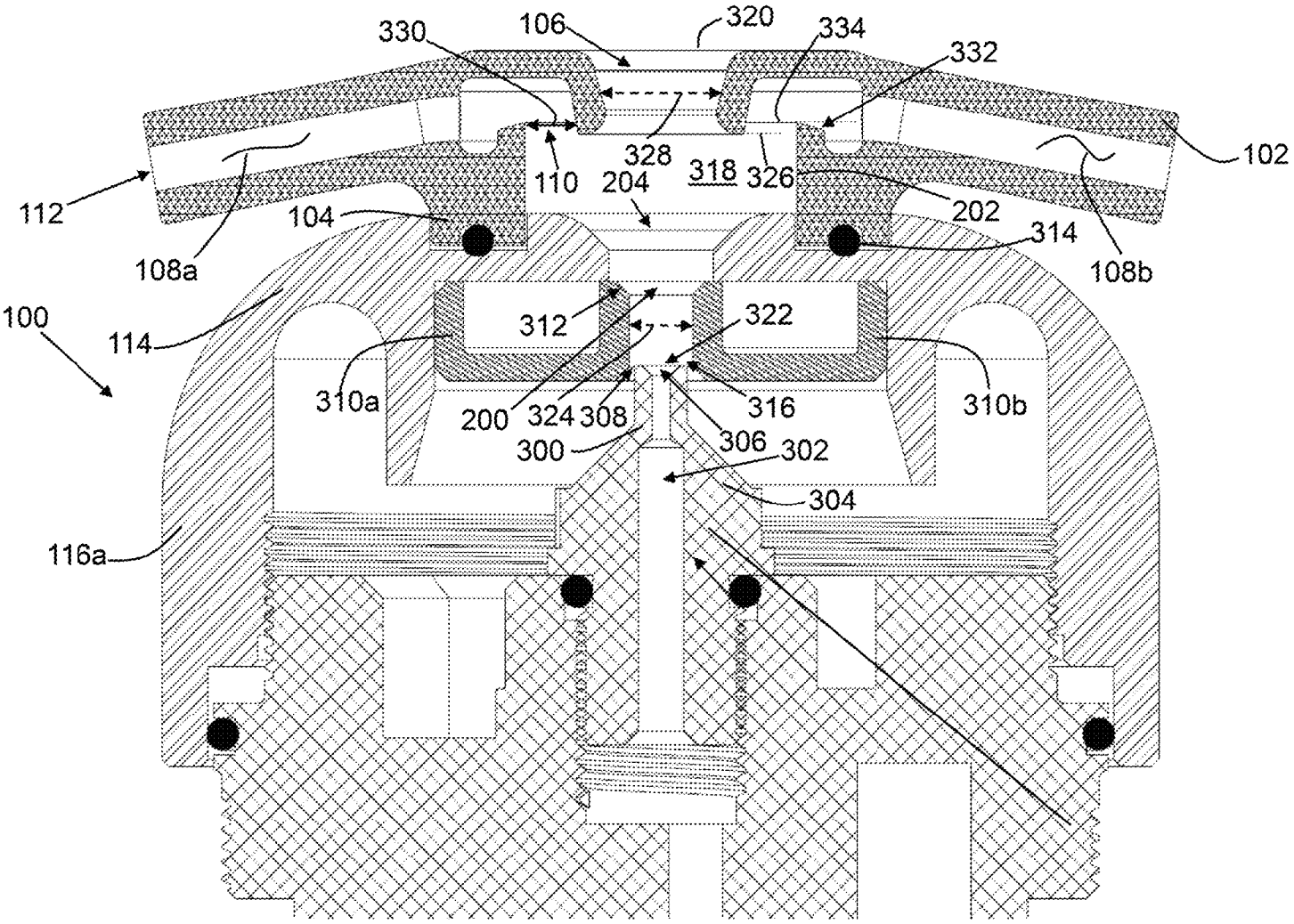
FIG. 3 is a sectioned side view of the size-selective aerosol nozzle device, in accordance with an embodiment of the present invention.
Figure 4:
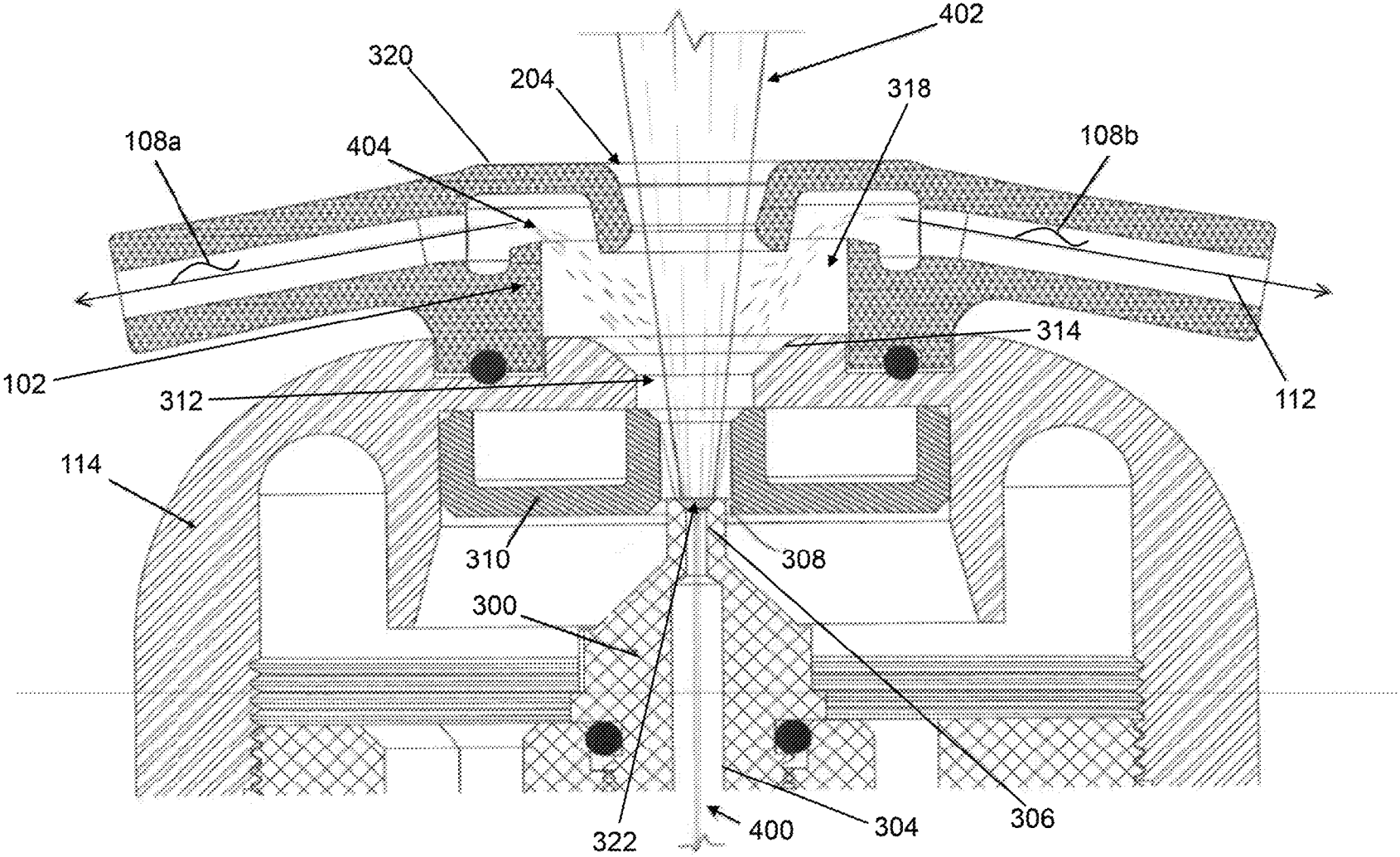
FIG. 4 is a sectioned side view of the size-selective aerosol nozzle device shown in FIG. 3, depicting the geometric and structural configuration of the cavity, borehole, inlet passageway, first aerosol discharge outlet, and liquid removal channel, in accordance with an embodiment of the present invention.

Referring now to FIGS. 1 and 3-4, one embodiment of the present invention is shown. The figures depicted herein show several advantageous features of the present invention, but, as will be described below, the invention can be provided in several shapes, sizes, combinations of features and components, and varying numbers and functions of the components. The first example of an impacting aerosol nozzle device 100, as shown in FIG. 1, includes an impacting aerosol nozzle device 100, hereafter "device 100" that works to segregate small, inhalable droplets 404 between 10 to 15 μm from a particulate substance spray cloud 402. The larger droplets, greater than 15 μm, disperse from the device 100 for application in a more uniform manner, as a result of removing the small droplets 404 of particulate substance.

Figure 2:
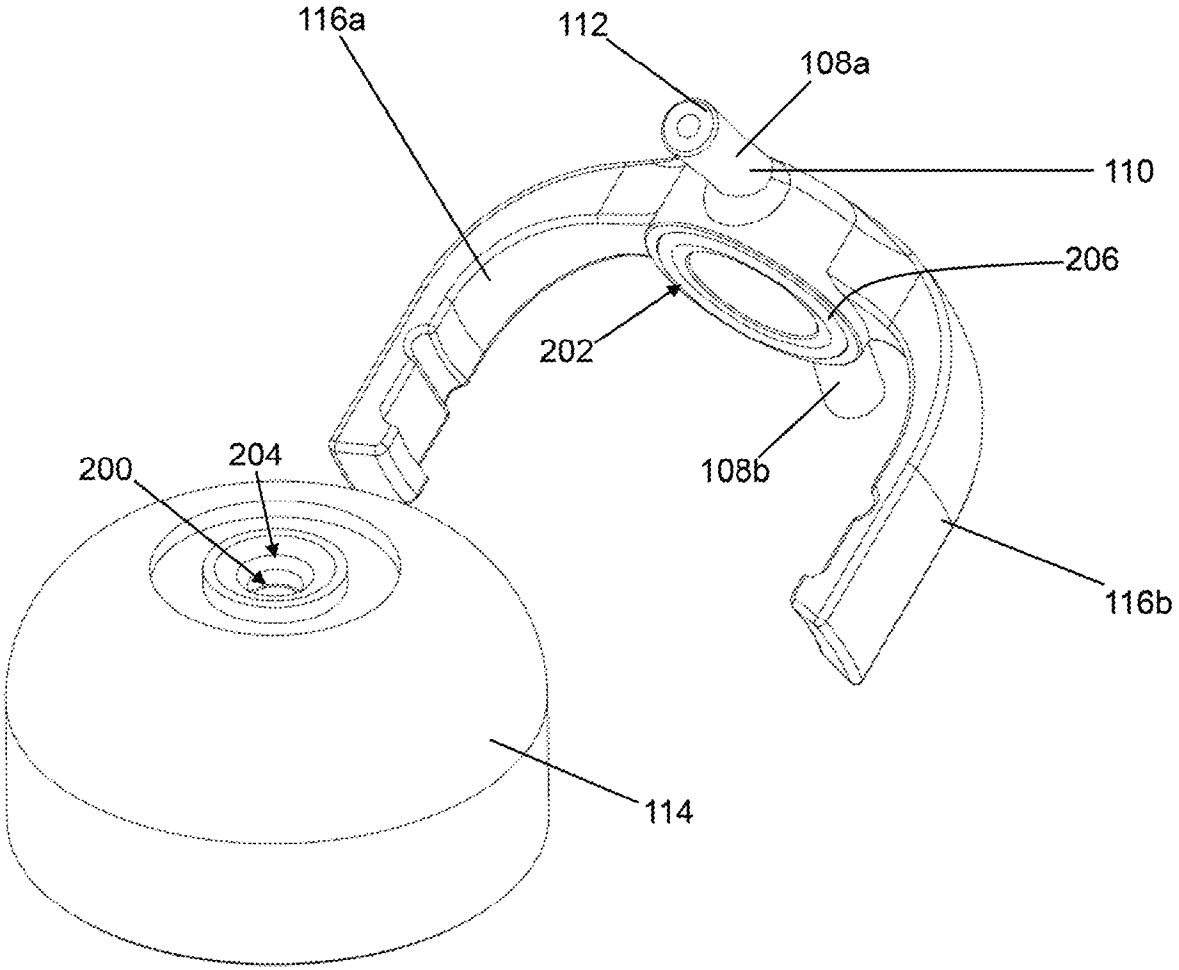
FIG. 2 is a perspective view of the size-selective aerosol nozzle device shown in FIG. 1, showing the impactor detached from the nozzle, in accordance with an embodiment of the present invention.

The device 100 may be employed in combination with an induction charged electrostatic nozzle 300 and an attached droplet impactor 102 that couple together in an overlapping, sheared geometric configuration. The nozzle 300 carries a solid liquid column 400 of particulate substance to be atomized. The impactor 102 facilitates in transforming the solid liquid column 400 into a particulate spray cloud 402 consisting of particulate droplets. The nozzle 300 and impactor 102 may be integrally joined or removably couplable. FIG. 3 illustrates the nozzle 300 and impactor 102 integrally joined, with a nozzle cover 114 encapsulating the nozzle 300 for protection. FIG. 2 illustrates the impactor 102 detached from the nozzle 300, with the nozzle cover 114 encapsulating the nozzle 300 for protection.

The device 100 also utilizes one or more liquid removal channels 108*a*, 108*b* in communication with the impactor 102 and a vacuum. The vacuum sucks the small droplets 404 from the primary spray cloud 402 passing through the impactor 102 through the liquid removal channel(s) 108*a*-*b*. The segregated small droplets 404 may then be recycled back into the particulate substance, or discarded for other uses. The pressure generated by the vacuum is adjustable to regulate the number of small droplets 404 sucked from the spray cloud 402. Further, at least one electrode 310*a*, 310*b* proximal to the impactor 102 creates an electric field that polarizes the particulates in the spray cloud 402. This charge helps to deviate the small droplets 404 away from the larger droplets that make up the spray cloud 402.

Furthermore, the device 100 is configured so that the geometric dimensions of boreholes, cavities, passageways, and conduit slopes that make up the nozzle 300 and impactor 102 may be dimensionally reconfigured to regulate the amount of smaller, inhalable droplets 404 that are segregated from the spray cloud 402. Thus, adjustments to vacuum pressure, electrode charges, and internal geometry of structural components create a tunable performance for selective sizing of particulate substance droplets in the spray cloud 402.

As shown in the sectioned view of FIG. 3, the device 100 comprises a nozzle 300 that is configured to receive a solid liquid column 400 of a particulate substance and discharge the particulate in the form of a spray cloud 402 for application. In some embodiments, the particulate substance may include, without limitation, paint, ink, a chemical, and a substance consisting of smaller particulates that may cause respiratory problems when inhaled. The particulate substance may also be useful for coating a surface; whereby a uniform coating is desired. Those skilled in the art will recognize that a spray cloud 402 consisting of uniformly-sized particulate droplets generally creates a more uniform coating production during application.

In one embodiment, the nozzle 300 is an induction charged electrostatic nozzle 300. Thus, the nozzle 300 initiates the uniform application of particulate substance by carrying the particulate substance as a solid liquid column 400, applying electrostatic forces to the solid liquid column 400, and converting the solid liquid column 400 to a spray cloud 402.

As FIG. 3 references, the nozzle 300 comprises a spray channel 302 that is utilized to carry the solid liquid column 400 of particulate substance. The spray channel 302 is defined by a wall 304, wherein the channel 302 is fluidly coupled to a source of the particulate substance. The spray channel 302 also has an oppositely disposed discharge end 306 that forms an orifice 322. The orifice 322 is sized and dimensioned to enable discharge of the particulate substance. In one embodiment, the spray channel 302 is defined by an elongated metal tube 304. Though any type of conduit known in the art of spray nozzles may be used.

The nozzle 300 employs a reverse conical member 312 through which the fluid spray passes for expansion into a spray cloud 402, and for facilitating segregation of the small droplets 404. The tapered, cone-shaped configuration of the reverse conical member 312 creates an effective path for narrowing and expanding the solid liquid column 400 during atomization. In this manner, the solid liquid column 400 can be narrowed; thereby reducing the atomization effectiveness and shifting the production curve.

The reverse conical member 312 has a wide end 314 and a narrow end 316. The narrow end 316 joins with the discharge end 306 of the spray channel 302. The wide end 314 disperses the particulate solution into a spray cloud 402, with help from pressurized air.

Figure 6:
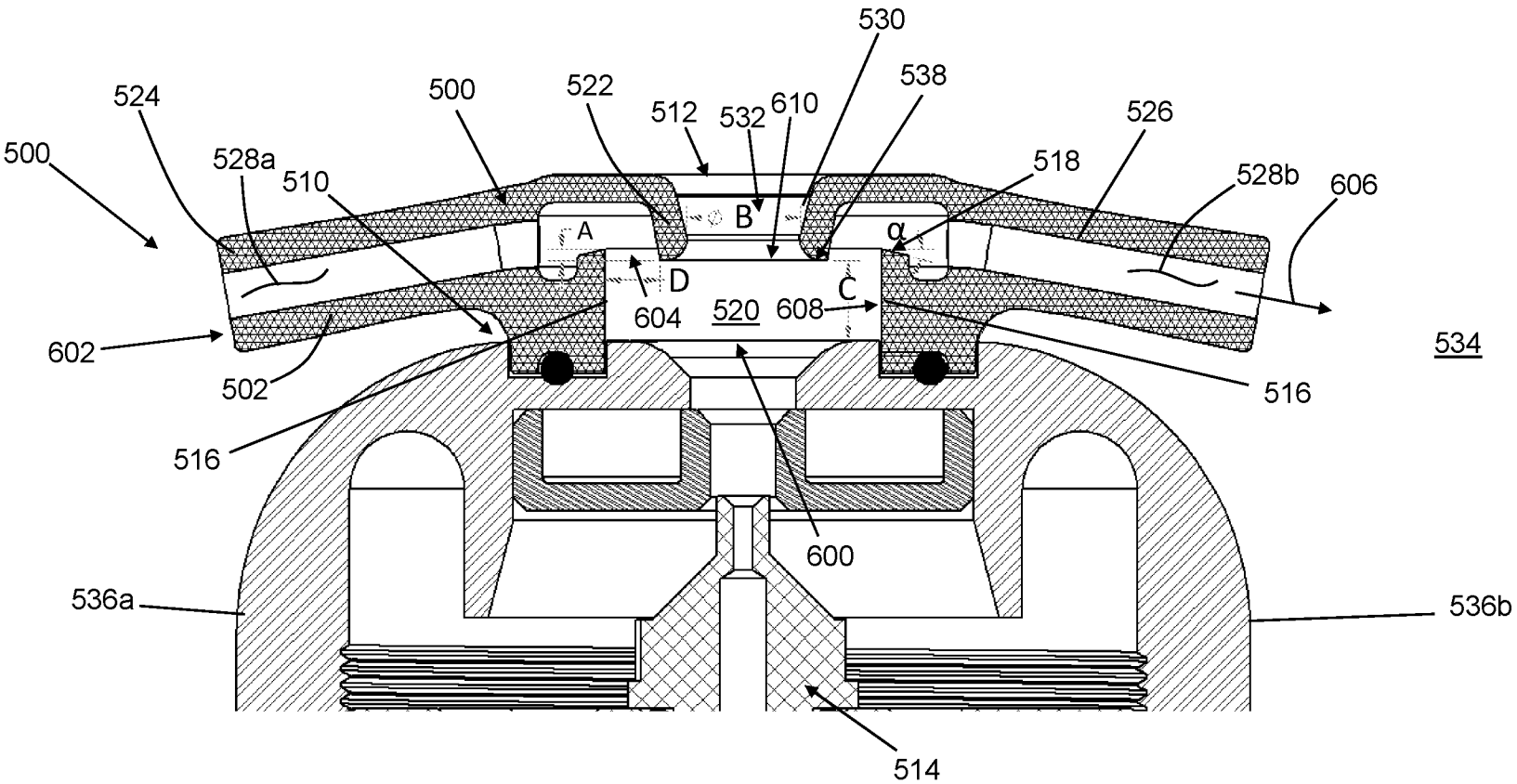
FIG. 6 is a sectioned side view of the size-selective aerosol nozzle device shown in FIG. 5, in accordance with an embodiment of the present invention.

Looking now at the geometric dimensions illustrated in FIGS. 3-4 and 6, the reverse conical member 312 is defined by a borehole 200 through which the particulate substance passes. In one embodiment, the borehole 200 may be concentric and in communication with the spray channel 302 of the nozzle 300. The borehole 200 is defined by a diameter 324. The diameter 324 may be increased or decreased to regulate passage of the solid liquid column 400 of particulate solution. For example, integrating a borehole 200 with a larger diameter increases the size of the solid liquid column 400. Thus, the nozzle 300, impactor 102, and reverse conical member 312 may have modular characteristics to enable this geometric size-adjustability.

The nozzle 300 further comprises an air inlet 308, terminating near the wide end 314 of the reverse conical member 312. The air inlet 308 carries pressurized air to the particulate substance that discharges from the wide end 314 of the reverse conical member 312. The pressurized air energizes the solid liquid column 400 to create a particulate spray cloud 402 comprising of droplets of particulate substance. The pressurized air may be generated from an external source and carried to the air inlet 308, or integral with the device 100. The amount of pressure in the pressurized air may be adjusted to help regulate the consistency of the spray cloud 402.

The nozzle 300 further comprises one or more electrodes 310. The electrode 310 generates an electric field through the particulate spray cloud 402. Consequently, the spray cloud 402 is charged to the opposite polarity as the electrode 310. Neither the liquid emitted from the nozzle 300 nor the atomized spray cloud 402 is meant to contact the electrode 310. Rather, the electrode 310 is disposed proximal to the reverse conical member 312 to optimize delivery of the charge on the spray cloud 402. As the solid liquid column 400 passes through the orifice 322, the electrode 310 creates an electrical field to charge fluid passing through the borehole 200 in the reverse conical member 312.

The electrostatic field generated by the electrode 310 separates the small droplets 404 of particulate substance from the larger droplets. The advantage of using electrodes 310 in this manner is that it produces high spray charging with very low electrode voltage and power. This electrostatic effect may work in conjunction with the vacuum generated through the one or more liquid removal channels 108*a*, 108*b* (described below), which sucks the small droplets 404 from the spray cloud 402.

The electrode 310 may be adjusted, or the electrode 310 replaced, to regulate the polarization of the particulates. For example, the charge of the electrode 310, the size of the electrode 310, or the material makeup of the electrode 310 is adjusted or changed to create different intensities of electrical charge; and thereby regulate deviation of the small droplets 404 in the spray cloud 402 towards the outlet passageway 112 of the liquid removal channels 108*a-b*.

The impactor 102 that may removably couple to the cover 114 to facilitate dispersing the particulate spray cloud 402 in the ambient environment and segregates the small droplets 404 of particulate from the spray cloud 402. Those skilled in the art will recognize that an impactor 102 is a mechanism utilized in hydraulic nozzle assemblies to segregate specific cut sizes of particulate droplets after the atomizing stage. These segregated, and often smaller, droplets may then be reinserted into the original flow or drained off. The segregated droplets can also be flooded with clean air in their segregation chamber to forcefully evaporate leaving only solid particles.

The impactor 102 is defined by a mount end 202 coupled to the wide end 314 of the reverse conical member 312. The mount end 202 has sidewalls 104 that form a cavity 318, also referred to as a central spray channel, for receiving the electrified spray cloud 402 from the reverse conical member 312. The spray channel may take any shape or dimension.

FIG. 4 illustrates the cavity 318 having a dimension 326 of approximately 0.175" in height. In other embodiments, additional dimensions may be used to adjustably regulate the size and flow velocity of droplets passing through the cavity 318. It is significant to note that the easiest way to create an artificial vacuum is to expand the volume of a container, which in this case includes expanding the size of the impactor 102 to have a larger cavity 318. This works to increase the number of small droplets 404 being electrostatically pulled and sucked from the spray cloud 402.

Thus, the dimension 326 of the cavity 318 can be changed to regulate passage of the particulate spray cloud 402 after exiting the first aerosol discharge outlet 204 and as it is carried through the outlet passageway 112 or channels 108*a-n* (which may be fluidly coupled to a fluid source through, e.g., a rubber conduit). In this manner, increasing the size of the cavity 318, allows a larger number of small droplets 404 to deviate from the particulate spray cloud 402. The dimension 326 of the cavity 318 may be changed by replacing the reverse conical member 312 or altering the dimensions or geometric shape of the sidewall 104.

The impactor 102 is further defined by a cap end 320 that forms a second aerosol discharge outlet 204. When the impactor 102 is coupled to the cover 114, the first aerosol discharge outlet 106 is in communication with the cavity 318. The impactor 102 may also define the second aerosol discharge 106. The second aerosol discharge outlet 106 is defined by a first width 328 of about 0.246". In one embodiment, the first width 328 is a median width, while in other embodiments it is an average width. Though in other embodiments, additional widths may be used to adjustably regulate the size and flow velocity of droplets passing through second aerosol discharge outlet 106.

A portion of the particulate droplets from the particulate spray cloud 402 pass through the first aerosol discharge outlet 204. In one embodiment, the portion of the particulate droplets from the particulate spray cloud 402 passing through the first aerosol discharge outlet 204 is generally larger than 15 μm. Though the air pressure, electrode charge, and vacuum, and geometric dimensions may be altered to increase or decrease the size of particulate droplets, however, passing through the second aerosol discharge outlet 106.

In one embodiment, a nozzle cover 114 detachably encapsulates the nozzle 300. The nozzle cover 114 may have a domed shape and be constructed from a rigid polymer or metal material. In another embodiment, a pair of legs 116*a*, 116*b* extend from the nozzle cover 114 to fasten the impactor 102 to the nozzle cover 114. The legs 116*a*, 116*b* may have an arcuate configuration terminating at a flange 118 disposed at a distal end 120 thereon.

Looking back at FIG. 1, the device 100 includes one or more liquid removal channel(s) 108*a*, 108*b* that extends from the impactor 102. The liquid removal channels 108*a-b* may be integral or detachable from the impactor 102. The liquid removal channels 108*a-b* may include two oppositely disposed, elongated tubes.

The liquid removal channels 108*a-b* are configured to carry the small droplets away from the primary spray cloud 402. In one non-limiting embodiment, the smaller particulates of the particulate spray cloud 402 passing through the outlet passageway 112 are generally between 10 to 15 μm. The liquid removal channels 108*a-b* are defined by an inlet passageway 110 that is in communication with the cavity 318 forming in the impactor 102. In one embodiment, the channels 108*a-b* are at least partially disposed in a generally perpendicular orientation with respect to the direction of flow of fluid through the aerosol discharge outlets 204, 106 formed on the cover 114 and impactor 102, respectively. In addition to the perpendicular orientation, the inlet passageway 110 may include a width 330 of about 0.118" (FIG. 4). Though in other embodiments, additional dimensions for the width 330 may be used to adjustably regulate the size of the small droplets. The width 330 can be increased or decreased to regulate passage of the small droplets 404 of the spray cloud 402 through the outlet passageway 112. This width-variance can be achieved by replacing components to achieve a different geometric configuration.

The liquid removal channels 108*a-b* is further defined by an outlet passageway 112, wherein the channels 108*a-b* may under negative pressure, produced for example, by a vacuum-inducing source. The vacuum works to force the small droplets 404 away from the primary spray cloud 402 in the cavity 318 of the impactor 102. The quality of the vacuum is adjustable to regulate the number of small droplets 404 being forced out through the passageways 110, 112.

In one embodiment, the quality of the vacuum comprises a negative pressure range of about 1-20 mm Hg. Thus, by increasing the vacuum pressure, a larger number of small droplets less than 10 μm may be force out from the particulate spray cloud 402. At a point, the size of the droplets being removed from the liquid removal channel 108*a-b* increases as the vacuum pressure increases. Conversely, reducing vacuum pressure lessens the number of small droplets 404 entering the liquid removal channels 108*a-b*, allowing more of the small droplets 404 to remain in the spray cloud 402.

As FIG. 4 illustrates, the channels 108*a-b* are disposed at a slope 332 of about 15° relative to a plane 334 defined by an aperture of the passageway 110. Though in other embodiments, the outlet passageway 112 may be configured into additional slopes to adjustably regulate the size of the small droplets 404. The slope 332 of the channels 108*a-b* may be oriented or canted away from the first aerosol discharge outlet 106 at various slopes.

The slope 332 of the channels 108*a-b* may be adjustable to regulate the passage of small droplets 404 away from the particulate spray cloud 402, and through the outlet passageway 112. For example, a larger slope may reduce the number of small droplets 404 passing through the liquid removal channels 108*a-b*, as the path through the liquid removal channels 108*a-b* is more resistant to particulate substances passing through.

In operation, the device 100 may be utilized by coupling the impactor 102 to the cover 114. As discussed above, the nozzle covers 114 is attached to protect the tip and conduit of the nozzle 300. The solid liquid column 400 is discharged through the spray channel 302 and nozzle 300 through selective operation of a switch, button, or other triggering mechanism known in the art to be used with an atomizing spray device. As the particulate substance passes through the spray channel 302, pressurized air passing through an air inlet 308 integrates with the solid liquid column 400 at the narrow end 316 of the reverse conical member 312. This works to create a particulate spray cloud 402 made up of variously sized particulate droplets.

The particulate spray cloud 402 expands while passing through the reverse conical member 312 and into the cavity or central spray channel 318 that is formed within the impactor 102. The size of the cavity/channel 318 is determinative of the volume of spray cloud 402 passing through the impactor 102. Thus, the dimension 326 of the cavity 318 may be increased or decreased to regulate spray cloud 402 formation and velocity.

The one or more electrodes 310 that are disposed near the impactor works to generate an electrical field that polarizes the particulates in the spray cloud 402. This electrical charge generates an electrical field that polarizes the small droplets, causing them to deviate towards the liquid removal channel 108*a-b* and away from the primary spray cloud 402. Further, the charge of the electrode 310*a-b*, the size of the electrode 310*a-b*, and the positioning of the electrode 310*a-b* can be regulated to increase or decrease the polarization effect on the particulates in the spray cloud 402.

A vacuum may be induced within liquid removal channel (s) 108*a-b* to facilitate in removing droplets from the spray cloud 402. Said another way, the liquid removal channel(s) 108*a-b* is/are in fluid communication with the cavity/channel 318, and the vacuum works to force the small droplets out of the spray cloud 402 in the cavity/channel 318 and into the passageway 110, through the channel(s) 108*a-n*, out through the passageway 112, and potentially back to the cloud fluid source.

Additionally, the internal geometry of the passageways 110, 112 of the liquid removal channel 108*a-b*, the borehole 200, the cavity/channel 318 forming in the reverse conical member 312, and the and the first and second aerosol discharge outlets 204, 106 may be changed and resized to further affect droplet size segregation from the spray cloud 402. In any case, the larger droplets, e.g., greater than approximately 15 μm, may be removed from the primary spray cloud 402 as they are emitted from the first aerosol discharge outlet 204. By removing the small droplets 404, the spray cloud 402 forms a uniform dispersion of the particulate substance outside of the respiratory range.

Figure 5:
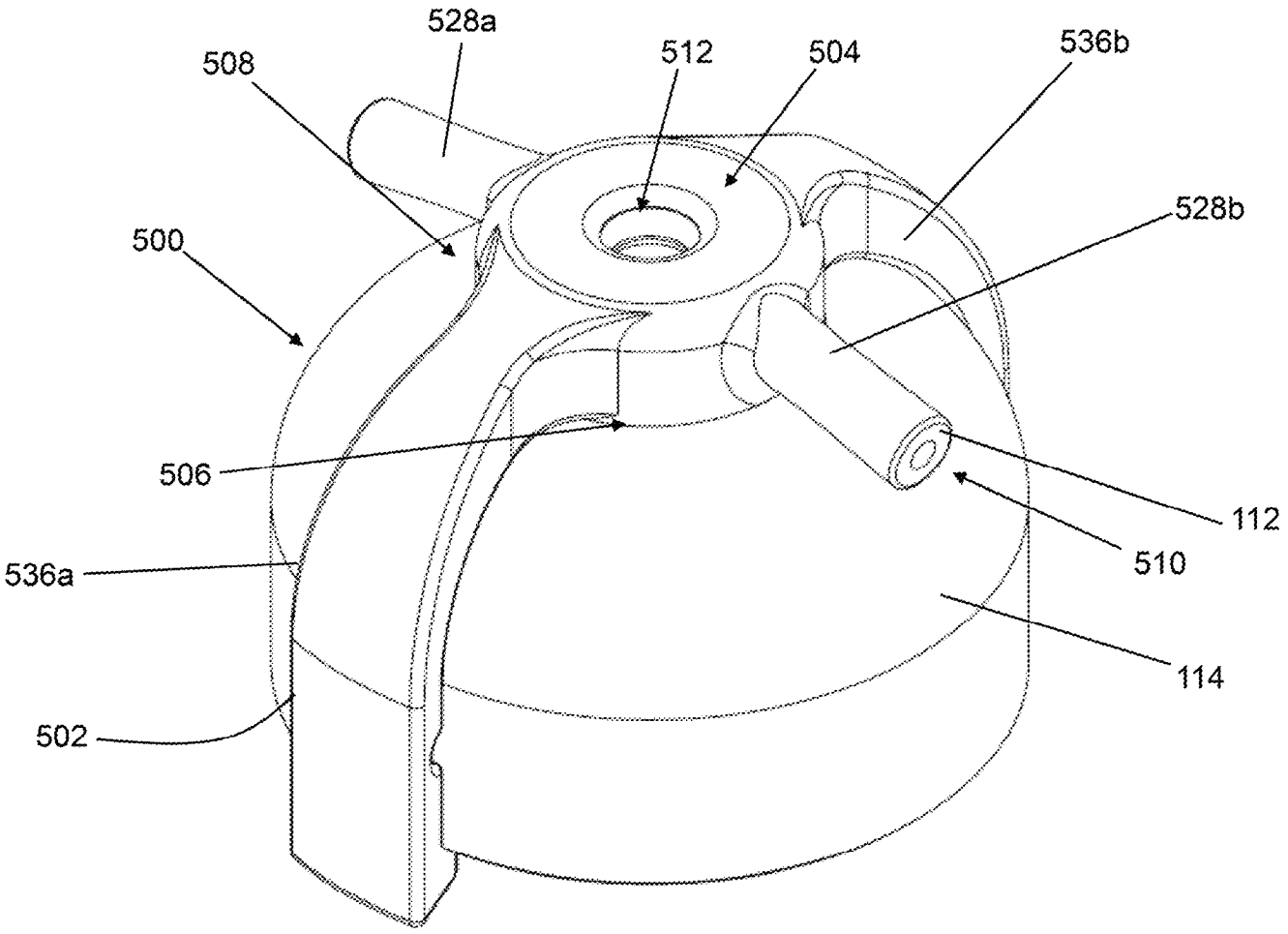
FIG. 5 is a perspective view of a size-selective aerosol nozzle device, in accordance with an embodiment of the present invention.

FIG. 5 illustrates another perspective view of a virtual impacting aerosol nozzle device 500. FIG. 5 depicts dimensions for device 500 that are proportionally related to each other, rather than being defined as lengths, diameters, and slopes. Specifically, the device 500 may be configured with an internal enclosed sidewall having different lengths of overlap, and variations of lengths, that are proportionally related or configured with respect to each other. The internal dimensions or geometry for the device 500 may also are defined by an aspect ratio for the geometric dimensions.

Thus, the lengths of the sidewalls are defined in relation to each other, and may be increased or decreased to regulate flow of spray cloud 402 and small droplets 404 in their respective paths. In this manner, the device 500 may be adapted to achieve varying separation of small droplets 404 from the spray cloud 402 into the liquid removal channel(s) 108*a-b*.

FIG. 6 references a cross-sectional view of the device 500 in FIG. 5. An impactor 502 may be removably couplable or integrated onto the distal end spray end 318 of a portable hand-held aerosol spray assembly. The impactor 502 is used to carry the particulate spray cloud 402 emitted from the first aerosol discharge outlet 512, which then segregates small droplets 404 of particulate from the spray cloud 402 into the one or more liquid removal channel(s) 108*a-b*, as described above. Those skilled in the art will recognize that an impactor is a mechanism utilized in hydraulic nozzle assemblies to segregate specific cut sizes of particulate droplets after the atomizing stage. These segregated, and often smaller, droplets may then be reinserted into the original spray cloud flow or drained off. The segregated small droplets can also be flooded with clean air in their segregation chamber to forcefully evaporate leaving only solid particles.

The impactor 502 may include a distal end 504 and a proximal end 506 that is operably configured to selectively and removably couple to a distal spray end 508. The distal spray end 508 includes a distal end surface 510 that defines a first aerosol discharge outlet 600 of a portable hand-held aerosol spray assembly 514. In some embodiments, the impactor 502 may have legs 536*a*, 536*b* for removably coupling to the spray assembly 514.

The impactor 502 comprises an internal enclosed sidewall 516 spanning in a directional longitudinally from the distal end surface 510 of the distal spray end 508 to a central sidewall terminal end 518 and defining a central spray channel 520. The central spray channel 520 is elongated or spans a length to carry the particulate solution to the second aerosol discharge outlet 512.

The impactor 502 further comprises a fluid segregation member 522. The fluid segregation member 522 is configured to separate the small droplets 404 from the spray cloud 402. The fluid segregation member 522 has an internal enclosed sidewall 524 defining one or more liquid removal channel(s) 528*a-b* that spans laterally away from, and in fluid communication with, the central spray channel 520. In one embodiment, the liquid removal channel(s) 528*a-b* comprise two oppositely disposed liquid removal channel(s) 528*a-b*. In one possible embodiment, the liquid removal channel(s) 528*a-b* are elongated tubes. In one embodiment, the sidewall 524 encloses the channel(s) 528*a-b* from the distal end 602 of the channel(s) 528*a-b* to a channel opening 604 disposed within the central spray channel 520. In other embodiments, the sidewall 524 does not have to be enclosed the entire length from the distal end 602 to the proximal end 604.

In communication with the at least one liquid removal channel is a vacuum assembly (represented schematically with numeral 534) operably coupled to the impactor 502 and configured to induce a vacuum (represented with arrow 606) within the liquid removal channel 528*a-b*. The vacuum assembly 534 may include an induced vacuum 606 that ranges from 1-20 mm of Hg. The impactor 502 further comprises, at the distal end 504 of the impactor 502, a second aerosol discharge outlet 512 in fluid communication with the central spray channel 520. The central spray channel 520 and liquid removal channel 528*a-b* are interposed with the first and second aerosol discharge outlets 600, 512. The fluid segregation member 522 spans into the central spray channel 520 to bifurcate the central spray channel 520 into the one or more liquid removal channel(s) 528*a-b*. Said another way, the inner sidewall 524 at least partially defines the channels 528*a-b*.

There is also an aerosol discharge channel 532 spanning to the second aerosol discharge outlet 512. In one embodiment, the first and second aerosol discharge outlets 600, 512 and the aerosol discharge channel 532 are axially aligned with one another. The second discharge aperture 512 may also be concentric with the channel 512 and/or first discharge aperture 600.

The fluid segregation member 522 has an inner surface 526 that at least partially defines the liquid removal channel 528*a-b*, and is in an overlapping configuration with the internal enclosed sidewall 516 of the impactor 502, specifically inner surface 608 of the sidewall 516. The fluid segregation member 522 works to mechanically segregate fluid droplets in the respiratory range from the aerosol spray cloud 402 emitted from the first aerosol discharge outlet 600 of the portable hand-held aerosol spray assembly 514 to the liquid removal channel 528*a-b*. In one embodiment, the impactor body 502 and the fluid segregation member 522 have a watertight coupling relationship on the nozzle cover 114. As shown best in FIG. 2, the impactor body 502 may be removably couplable to the distal spray end 510 in a watertight coupling relationship, e.g., through an O-ring washer 206 disposed at a mount end 202 of the impactor body 502.

The dimensions of the internal enclosed sidewalls 516, 524 within the fluid segregation member 522 and the central spray channel 520 may include an offset length "A" defined by a length of overlap of the internal enclosed sidewall 516 of the impactor and the inner surface 526 of the fluid segregation member 522 in the overlapping configuration. There is also a dimension of a spacer length "C" separating a terminal end 538 of the fluid segregation member 522 disposed within the central spray channel 520 and the first aerosol discharge outlet 512. The lengths A and C have a respective aspect ratio of approximately 1:7. Though in other embodiments, the aspect ratio of lengths A and C may be greater or smaller, such as 1:10 or 1:3.

In some embodiments, the fluid segregation member 522 may include a terminal end 538 disposed within the central spray channel 520 and defining an annular opening 610. Said another way, the terminal end 538 of the segregation member 522 may terminate into an annular shape that defines the annular opening 610. The aerosol discharge channel 532 is of an inverted conical shape spanning from the annular opening 610 to the second aerosol discharge outlet 512.

This inverted conical shape provides a unique conduit through which the solid liquid column 400 passes for expansion into a spray cloud 402, and for facilitating segregation of the small droplets 404. The tapered, cone-shaped configuration of the aerosol discharge channel 532 creates an effective path for narrowing and expanding the solid liquid column 400 during atomization.

The fluid segregation member 522, specifically the second aerosol discharge outlet 512, may also define a diameter length "B". There is also a diameter length "D" separating the terminal end 538 of the fluid segregation member 522 and an inner surface of the internal enclosed sidewall 516 of the impactor body 502. In one embodiment, lengths B and D have a respective aspect ratio of approximately 1:0.48. Though in other embodiments, the aspect ratio of lengths B and D may be greater or smaller, such as 1:2 or 1:0.10. In yet another embodiment, the lengths A and B have a respective aspect ratio of approximately 1:0.48.

It is significant to note that testing the application of a spray cloud 402 on a surface illustrates the advantages of separating small droplets 404 from the spray cloud 402. Removing smaller proportions of small droplets 404 from the spray cloud 402 shows that surface coverage is not adversely affected, while also providing the benefit of removing the smaller, inhalable particulates of solution from the respiratory range.

Figure 7:
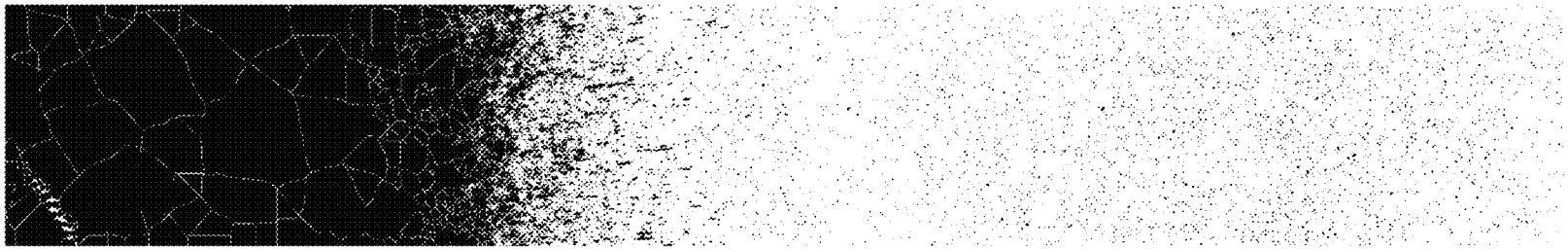
FIG. 7 is a first spray distribution sample from an experimental spraying of a particulate solution without use of the virtual impacting aerosol nozzle device, in accordance with an embodiment of the present invention.

For example, in one exemplary experiment depicted in FIG. 7, a first spray distribution sample 700 is applied to a surface. The first spray distribution does not utilize the device 100, but rather employed a standard spray nozzle. Looking now at a second spray distribution sample 800 applied to a second surface in FIG. 8, the device 100 performs a second spray distribution sample 800 using the device 100. The results are noticeably different.

The first spray distribution sample 700, depicted in FIG. 7, illustrates a larger spectrum of droplet size production. The latter spray distribution from the second spray distribution sample 800, depicted in FIG. 8, benefits from the devices 100 unique adjustable internal geometry and/or configuration of the impactor body 502.

Figure 9:
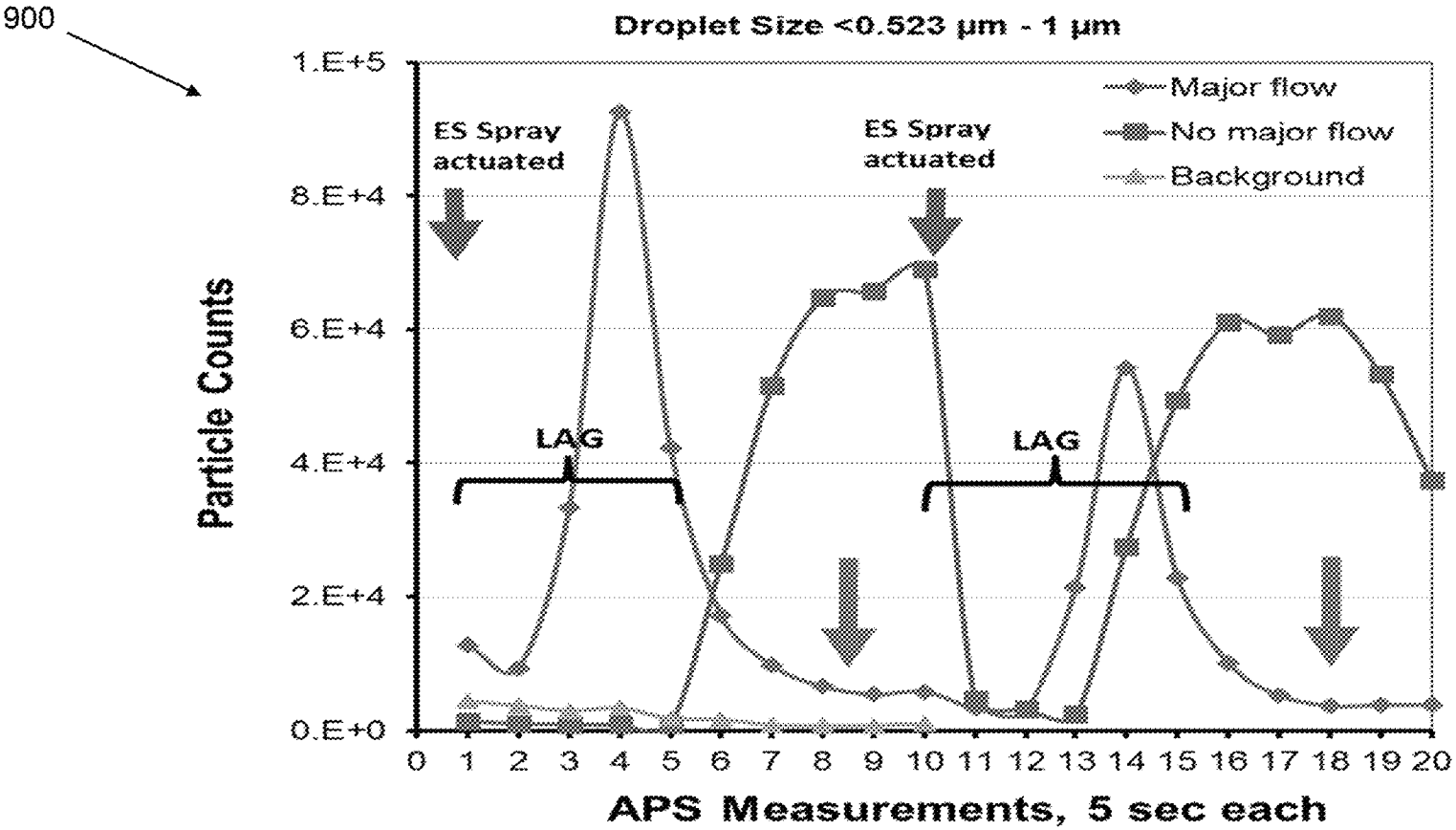
FIG. 9 is a testing chart illustrating the benefits of utilizing a virtual impacting aerosol nozzle device to help remove the small droplets.

Looking now at Table 900 in FIG. 9, an experimental test illustrates the benefits of utilizing a special impactor body 502. Namely, a linear slot virtual impactor (LSVI) to help remove small droplets 404 from the spray cloud 402. The data contained in Table 900 is based on experimental removal of small droplets 404 from an electrostatic spray using the LSVI developed at the Aerosol Technology Laboratory at MEEN TAMU.

As discussed above, the impactor is configured to carry the particulate spray cloud, and segregates the small droplets of particulate from the spray cloud. The LSVI is often used with hydraulic nozzles to segregate specific cut sizes of particulate droplets, after the atomizing stage. These segregated, and often smaller, droplets may then be reinserted into the original flow or drained off through the LSVI.

Preliminary testing was performed in a 2'×2' flow cell using the LSVI to remove small, respirable particulates from an electrostatic spray output. The experiment included both a major flow rate of 45 L/min, and a minor flow rate of 5 L/min, selected for the LSVI, respectively. The test results show that when the major flow is actuated during the spraying, there occurs a short lag period due to the logistics of the experiment. By optimizing the major and minor flow rate parameters, the initial lag phase of the small droplets being removed can be minimized.

Nonetheless, the small droplets are stripped from the spray cloud. This assertion is based on the particle counts by an Aerosol Particle Sizer (APS 3321, TSI, Burnsville). The average decrease in particle concentration is less than 10 times for respirable submicron particles. But the decrease in particle concentration is less than 1 μm when the LSVI major flow is operable, as shown in Table 700.

Thus, as Table 900 shows, the respirable submicron particle size range, <0.523 μm-1 μm is shown on the graph. The abscissa numbers correspond to the twenty APS measurements, 5 seconds each. The spray was actuated and ten (5 seconds each) measurements with the APS were recorded, for a total period of 50 seconds. The test was repeated with each LSVI configuration (with or without major flow). The arrows indicate the effect of the LSVI removing the submicron particles.

Figure 8:
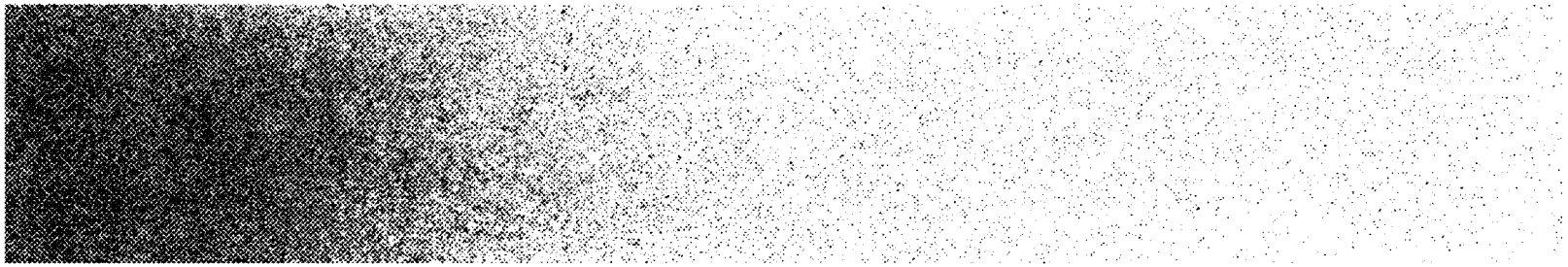
FIG. 8 is a second spray distribution sample from an experimental spraying of a particulate solution with the virtual impacting aerosol nozzle device, in accordance with an embodiment of the present invention.

The results are depicted in FIG. 10, Test Results Table 1000, which shows the particle concentration of the ES spray with and without LSVI major flow. With a minor flow of spray, there is a 90.7% decrease in small droplets. With a major flow of spray, there is a 91.3% decrease in small droplets. This reduction in small droplets 404 works to both create a more uniform application, as shown in FIGS. 7 and 8, and also to reduce repository hazards. Thus, the LSVI efficiently strips the smaller particulates from the electrostatic spray cloud 402 to prevent the penetration of fine, inhalable particles in the lungs. This reduces the exposure of an operator to harmful chemicals and facilitates re-entry to work spaces.

Those skilled in the art will recognize that the production of small droplets during atomization of a particulate substance is often caused by a number of variables and system inputs. As with any aerosolizing device, pneumatic and hydraulic alike, there are a wide range of droplet sizes produced throughout its entire spectrum. Mitigating or narrowing of this production curve often requires a multi-prong pragmatic developmental path.

For example, the device 100 may utilize correlated adjustments to air energy and volumetric rates based on solution characteristics. Given certain allowable exposure limits for specific compounds, an adjustment could be correlated to specific chemistries of the particulate substance. These adjustments could include reduction in air energy or increases in liquid rates. The device 100 may also be used to increase the shear strength of a given solution compound; i.e. increase relative density, viscosity. This could include thickening agents, adjustments in surfactants, anti-drift agents, etc.

Further, the device 100 may also incorporate an auxiliary particulate mass air exchanger to help in optimal application of the particulate substance. The particulate mass air exchanger is utilized as an additional means to accelerate reentry times. Run times could be associated to room size, PPM measurements, etc. The device 100 may also include an HVLP blower that utilizes a particulate filtering provision, also utilizing the air volume available by the sprayer to create air movement in a given room; thereby accelerating the process even further.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense.

Thus, the scope of the invention should be determined by the appended claims and their legal equivalence.

What is claimed is:

1. A droplet size segregation aerosol nozzle device comprising: an impactor body having a distal end and a proximal end operably configured to selectively removably couple to a distal spray end, having a distal end surface defining a first aerosol discharge outlet, of a portable hand-held aerosol spray assembly, the impactor body having: an internal enclosed sidewall spanning in a directional longitudinally from the distal end surface of the distal spray end to a central sidewall terminal end and defining a central spray channel; and a fluid segregation member: with an internal enclosed sidewall defining at least one liquid removal channel spanning laterally away from, and in fluid communication with, the central spray channel; at least partially defining, at the distal end of the impactor body, a second aerosol discharge outlet in fluid communication with the central spray channel, the central spray channel and liquid removal channel interposed with the first and second aerosol discharge outlets; and spanning into the central spray channel to bifurcate the central spray channel into the at least one liquid removal channel and an aerosol discharge channel spanning to the second aerosol discharge outlet, the fluid segregation member with an inner surface at least partially defining the liquid removal channel and in an overlapping configuration with the internal enclosed sidewall of the impactor body to mechanically segregate emitted aerosol spray from the first aerosol discharge outlet of the portable hand-held aerosol spray assembly to the liquid removal channel; further comprising: an offset length "A" defined by a length of overlap of the internal enclosed sidewall of the impactor body and the inner surface of the fluid segregation member in the overlapping configuration; and a spacer length "C" separating a terminal end of the fluid segregation member disposed within the central spray channel and the first aerosol discharge outlet, wherein lengths A and C have a respective aspect ratio of approximately 1:7.

2. The droplet size segregation aerosol nozzle device according to claim 1, wherein:

the first and second aerosol discharge outlets and the aerosol discharge channel are axially aligned with one another.

3. The droplet size segregation aerosol nozzle device according to claim 1, wherein the fluid segregation member further comprises:

a terminal end disposed within the central spray channel and defining an annular opening, wherein the aerosol discharge channel is of an inverted conical shape spanning from the annular opening to the second aerosol discharge outlet.

4. The droplet size segregation aerosol nozzle device according to claim 1, further comprising:

a vacuum assembly operably coupled to the impactor body and configured to induce a vacuum within the liquid removal channel.

5. The droplet size segregation aerosol nozzle device according to claim 4, wherein:

the induced vacuum ranges from 1-20 mm of Hg.

6. The droplet size segregation aerosol nozzle device according to claim 1, further comprising: a diameter length "B" defined by the second aerosol discharge outlet; and a diameter length "D" separating the terminal end of the fluid segregation member and an inner surface of the internal enclosed sidewall of the impactor body, wherein lengths B and D have a respective aspect ratio of approximately 1:0.48.

7. The droplet size segregation aerosol nozzle device according to claim 6, wherein:

the lengths A and B have a respective aspect ratio of approximately 1:0.48.

8. The droplet size segregation aerosol nozzle device according to claim 1, wherein:

the impactor body comprises a pair of legs for removably coupling to the sprayer.

9. The droplet size segregation aerosol nozzle device according to claim 1, wherein:

the impactor body is operably configured to selectively removably couple to the distal spray end in a watertight coupling relationship.

10. The droplet size segregation aerosol nozzle device according to claim 1, wherein:

the at least one liquid removal channel comprises two oppositely disposed liquid removal channels.

11. In combination with an electrostatic sprayer with a liquid discharge tip surrounded by an electrode and with a distal end surface defining a first aerosol discharge outlet for discharge of a charged aerosol spray, wherein the improvement comprising: an impactor body with an internal enclosed sidewall surrounding the first aerosol discharge outlet and spanning in a directional longitudinally from the distal end surface to a central sidewall terminal end and defining a central spray channel, the impactor body including a fluid segregation member: with an internal enclosed sidewall defining a liquid removal channel spanning laterally away from, and in fluid communication with, the central spray channel; at least partially defining, at the distal end of the impactor body, a second aerosol discharge outlet in fluid communication with the central spray channel, the central spray channel and liquid removal channel interposed with the first and second aerosol discharge outlets; and spanning into the central spray channel to bifurcate the central spray channel into the at least one liquid removal channel and an aerosol discharge channel spanning to the second aerosol discharge outlet, the fluid segregation member with an inner surface at least partially defining the liquid removal channel and in an overlapping configuration with the internal enclosed sidewall of the impactor body to mechanically segregate the charged aerosol spray from the first aerosol discharge outlet to the liquid removal channel; further comprising: an offset length "A" defined by a length of overlap of the internal enclosed sidewall of the impactor body and the inner surface of the fluid segregation member in the overlapping configuration; and a spacer length "C" separating a terminal end of the fluid segregation member disposed within the central spray channel and the first aerosol discharge outlet, wherein lengths A and C have a respective aspect ratio of approximately 1:7.

* * * * *